US009822678B2

(12) United States Patent
Steiner et al.

(10) Patent No.: US 9,822,678 B2
(45) Date of Patent: Nov. 21, 2017

(54) INTERNAL COMBUSTION ENGINE WITH A LUBRICATION SYSTEM AND METHOD FOR PRODUCING AN INTERNAL COMBUSTION ENGINE

(71) Applicant: Ford Global Technologies, LLC, Dearborn, MI (US)

(72) Inventors: Bernd Steiner, Bergisch Gladbach (DE); Thomas Lorenz, Cologne (DE); Jan Mehring, Cologne (DE)

(73) Assignee: Ford Global Technologies, LLC, Dearborn, MI (US)

( * ) Notice: Subject to any disclaimer, the term of this patent is extended or adjusted under 35 U.S.C. 154(b) by 898 days.

(21) Appl. No.: 13/648,945

(22) Filed: Oct. 10, 2012

(65) Prior Publication Data

US 2013/0092118 A1 Apr. 18, 2013

(30) Foreign Application Priority Data

Oct. 17, 2011 (DE) ..... 10 2011 084 597

(51) Int. Cl.
*F01M 1/02* (2006.01)
*F01M 11/02* (2006.01)

(52) U.S. Cl.
CPC ..... *F01M 11/02* (2013.01); *F01M 2011/026* (2013.01); *Y10T 29/4927* (2015.01); *Y10T 29/49272* (2015.01)

(58) Field of Classification Search
USPC ..... 123/196 R, 196 CP, 196 AB
See application file for complete search history.

(56) References Cited

U.S. PATENT DOCUMENTS

| | | | | |
|---|---|---|---|---|
| 5,517,959 | A * | 5/1996 | Kato et al. | 123/196 AB |
| 6,278,084 | B1 * | 8/2001 | Maynard | 219/209 |
| 6,557,533 | B2 * | 5/2003 | Katayama et al. | 123/516 |
| 7,137,376 | B2 * | 11/2006 | Ito | 123/196 R |
| 2009/0272533 | A1 * | 11/2009 | Burns et al. | 166/272.7 |
| 2009/0313847 | A1 * | 12/2009 | Weigelt | 34/282 |
| 2010/0147255 | A1 * | 6/2010 | Toda | 123/196 R |
| 2010/0154748 | A1 * | 6/2010 | Rabhi | 123/48 C |
| 2010/0199941 | A1 * | 8/2010 | Steiner et al. | 123/196 AB |
| 2010/0221473 | A1 * | 9/2010 | Biris | 428/35.9 |
| 2012/0006622 | A1 | 1/2012 | Will | |

FOREIGN PATENT DOCUMENTS

| | | | |
|---|---|---|---|
| CN | 201255041 | Y | 6/2009 |
| JP | S59183016 | A | 10/1984 |
| JP | 2004232546 | A | 8/2004 |

OTHER PUBLICATIONS

VDI-Gesellschaft Verfahrenstechnik und Chemieingenieurwesen, Table 6, 5 pages.
Partial Translation of Office Action of Chinese Application No. 2012103954332, dated Dec. 28, 2015, State Intellectual Property Office of PRC, 11 Pages.

* cited by examiner

*Primary Examiner* — Lindsay Low
*Assistant Examiner* — Omar Morales
(74) *Attorney, Agent, or Firm* — Julia Voutyras; McCoy Russell LLP

(57) ABSTRACT

A lubrication system in an internal combustion engine is provided. The lubrication system includes a crankshaft bearing supporting a crankshaft, a supply line including an outlet flowing oil to the crankshaft bearing and an inlet receiving oil from an oil gallery, and thermal insulation at least partially surrounding at least a portion of an inner wall of the supply line and/or the oil gallery.

19 Claims, 2 Drawing Sheets

INTERNAL COMBUSTION ENGINE WITH A LUBRICATION SYSTEM AND METHOD FOR PRODUCING AN INTERNAL COMBUSTION ENGINE

CROSS-REFERENCE TO RELATED APPLICATIONS

This application claims priority to German application number 102011084597.6 filed on Oct. 17, 2011, the entire contents of which are hereby incorporated herein by reference for all purposes.

FIELD

The present disclosure relates to an internal combustion engine lubrication system and a method for manufacturing a lubrication system.

BACKGROUND AND SUMMARY

An internal combustion engine may be used to provide motive power to vehicles. It will be appreciated that the term internal combustion engine includes diesel engines, spark ignition engines, hybrid internal combustion engines, etc.

During cold engine starts, engine oil may be below a desired temperature. As a result, combustion efficiency may be decreased and emissions may be increased. Attempts have been made to actively warm oil via a heating apparatus. The heating apparatus may increase the cost of the engine. Furthermore, the heating apparatus may not heat the oil in a desired duration.

Other attempts have been made to store the engine oil which is warmed during operation in an insulated container, so that, when the internal combustion engine is started again, pre-warmed oil is available. A drawback with this procedure is that the oil which has been warmed during operation cannot be kept for unlimited time at a desired temperature, so that a renewed warming of the oil in the warm-up phase of the internal combustion engine may be desired. Additionally, heat may be removed from the oil as it flows through the crankcase, which after a cold start is not warmed by combustion operation in the engine. The heating apparatus and/or insulated container may not provide a desired amount of heat to the oil to counteract the cooling of the oil in the crankcase after a cold start. For example, warmed oil may be cooled as it travels through the crankcase, due to the cold engine structure, on its way to oil consuming devices (e.g., crankshaft bearings).

Further, the cylinder block and/or the cylinder head of an internal combustion engine are a thermally stressed component and therefore may be equipped with a fluid cooling system. The heat balance of the internal combustion engine may be controlled by this cooling, which may make rapid warming of the engine oil during the warm-up phase difficult to achieve.

To solve at least some of the aforementioned problems, a lubrication system in an internal combustion engine is provided. The lubrication system includes a crankshaft bearing supporting a crankshaft, a supply line including an outlet flowing oil to the crankshaft bearing and an inlet receiving oil from an oil gallery, and thermal insulation at least partially surrounding at least a portion of an inner wall of the supply line and/or the oil gallery.

In this way, the oil-carrying lines may be provided with insulation which decreases heat transfer from the oil to the cylinder block and/or surrounding environment. As a result, the oil provided to the bearing may be at a desirable temperature.

The thermal insulation may include a polymeric material in some examples. The polymeric material may provide desired insulation properties. Specifically, polymeric material has a low heat transfer coefficient and possesses low conductivity and therefore may act as a heat barrier, thereby reducing the heat flow from the oil to the cylinder block, as compared to metal components.

Further in some examples, the thermal insulation may include a treatment applied to the surface of the inner wall. For example, an anodic oxidation may be applied in an electrolytic process, in which an oxide layer is produced on the surface of the inner wall, which is distinguished by a substantially higher strength but also has properties for the formation of a heat barrier. Another advantage of the surface treatment is that—for example, in anodization—the oxide layer grows from the surface into the material or metal, so that the geometric dimensions of the oil-carrying lines may remain unaltered, if desired.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure. Additionally, the above issues have been recognized by the inventors herein, and are not admitted to be known.

Figure 1:
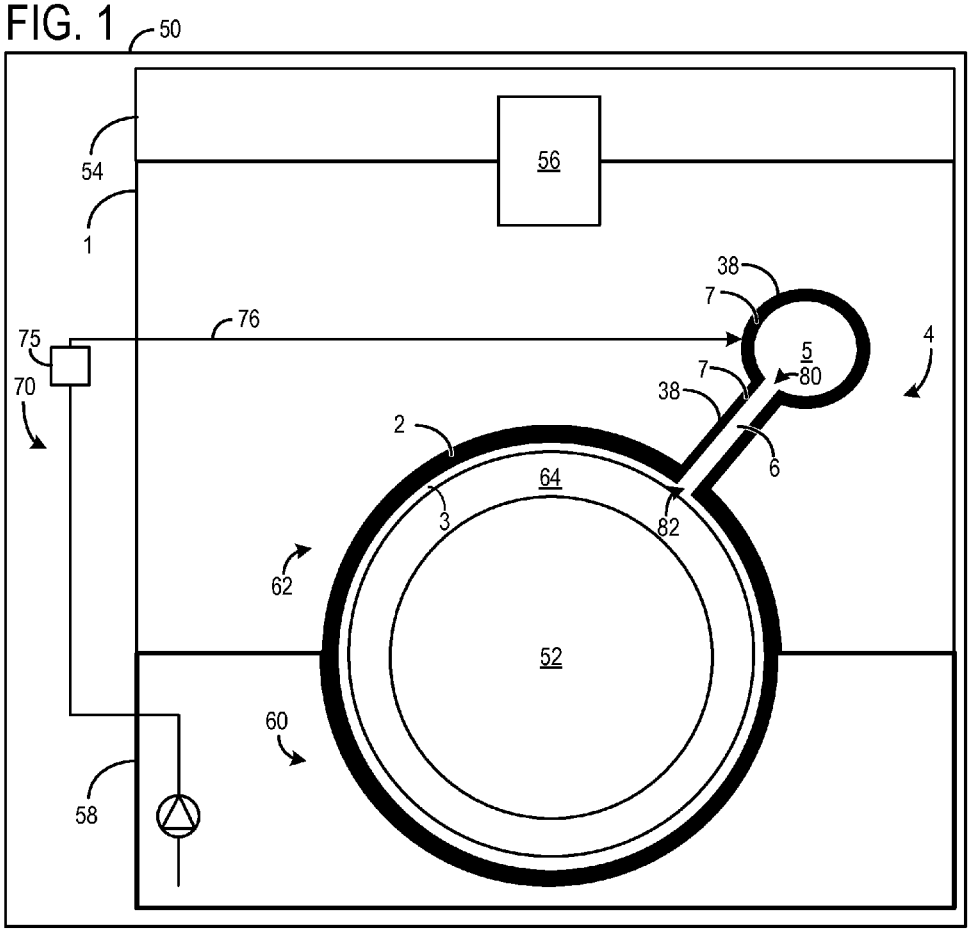
FIG. 1 shows a schematic depiction in cross section of an internal combustion engine including a bearing cap and a lubrication system for supplying oil to the bearing cap.

The internal combustion engine is described in greater detail below with reference to the illustrative examples shown in FIGS. 1-3.

DETAILED DESCRIPTION

An internal combustion engine is described herein. The internal combustion engine may include a cylinder block and a cylinder head, which are connectable or connected to each other to form the individual cylinders, i.e. combustion chambers. The individual component parts will be explained below.

The cylinder block may have for the reception of the pistons or cylinder liners a corresponding number of cylinder bores. The piston of each cylinder of an internal combustion engine may be guided in an axially movable manner in a cylinder liner and delimits, together with the cylinder liner and the cylinder head, the combustion chamber of a cylinder. The piston crown here may form a part of the combustion chamber inner wall and, together with the piston rings, seals off the combustion chamber from the cylinder block or the crankcase, so that substantially no combustion gases or combustion air get into the crankcase and no oil gets into the combustion chamber.

The pistons may serve to transmit the gas forces generated by the combustion to the crankshaft. To this end, each piston may be articulately connected by a piston pin to a connecting rod, which in turn is movably mounted on the crankshaft.

The crankshaft mounted in the crankcase may absorb the connecting rod forces, which may be composed of the gas forces resulting from the fuel combustion in the combustion chamber and the forces of inertia resulting from the non-uniform motion of the power transmission elements. The oscillating stroke motion of the pistons may be transformed into a rotating rotary motion of the crankshaft. The crankshaft may then transmit the torque to the drive train. A part of the energy transmitted to the crankshaft may be used to drive auxiliary power units, such as the oil pump and the dynamo or serves to drive the camshaft and thus actuate the valve gear.

An upper crankcase portion (e.g., upper crankcase half) may be formed by the cylinder block. The crankcase is completed by a lower crankcase portion (e.g., lower crankcase half), which can be fitted onto the upper crankcase portion and may serve as an oil pan. The upper crankcase portion may have a flange face for receiving the oil pan, (i.e. the lower crankcase portion). To seal off the oil pan or crankcase from the environment, a seal may be provided in or on the flange face. The connection may be a screw joint or other suitable attachment technique.

For the reception and mounting of the crankshaft, at least two bearings may be provided in the crankcase. The bearings may be of two-part construction and may each comprise a bearing saddle and a bearing cap connectable to the bearing saddle. The crankshaft may be mounted in the region of the crankshaft journals, which may be arranged along the crankshaft axis at a distance apart and may be configured as thickened shaft shoulders. Bearing caps and bearing saddles may be configured as separate component parts or in one piece with the crankcase, (i.e. the crankcase portions). Between the crankshaft and the bearings, bearing shells may be arranged as intermediate elements.

In the mounted state, each bearing saddle may be connected to the corresponding bearing cap. A bearing saddle and a bearing cap may respectively form a bore for receiving a crankshaft journal. The bore may be used for interaction with bearing shells as intermediate elements. The bores may be supplied with engine oil, i.e. lubricating oil, so that a supportive lubricating film may be formed between the inner face of each bore and the associated crankshaft journal in the case of a revolving crankshaft—similar to a slide bearing. Alternatively, a bearing can also be configured in one piece, for example in the case of a constructed crankshaft.

In order to supply the bearings with oil, a pump for delivering engine oil to the at least two bearings may be provided, wherein the pump, via a supply line, supplies an oil gallery, from which channels lead to the at least two bearings, with engine oil.

For the formation of the oil gallery, a main supply channel, which is oriented along the longitudinal axis of the crankshaft, is frequently provided. The main supply channel can be disposed above or below the crankshaft in the crankcase, or else at the same height, in particular can be integrated into the crankshaft.

The oil-carrying lines of the oil circuit may lead through the cylinder block and, where desired, through the cylinder head, may also repeatedly leave and re-enter the block or head and may, in addition to the crankshaft bearings, supply further consuming devices with oil, for example a camshaft, which may be mounted in a two-part, so-called camshaft holder.

The camshaft holder may be supplied with lubricating oil, for which purpose a supply line, which, in overhead camshafts, may extend into the cylinder head and may be connected to the oil gallery and run through the cylinder block, may be provided.

Further consuming devices can be, for example, the bearings of a connecting rod or of a possibly provided balance shaft. Also a consuming device in the abovementioned sense may be a spray-oil cooling device, which may be configured to wet the piston crown from below with engine oil by means of nozzles for cooling purposes, i.e. on the crankcase side, and therefore requires oil for operation.

A hydraulically actuable camshaft adjuster, or other valve gear component parts, for example for hydraulic valve clearance compensation, likewise may use engine oil and specifically use engine oil for operation.

An oil filter or oil cooler, provided in the supply line, may also be supplied with oil. Although these components of the oil circuit may also be supplied with engine oil, an oil circuit entails the use of these components, which have tasks or functions, which relate to the oil per se, whereas it is a consuming device which enables functionality of lubrication system.

The friction in the consuming devices to be supplied with oil, for example the bearings of the crankshaft, may be dependent on the viscosity, and thus the temperature, of the provided oil and contributes to the fuel consumption of the internal combustion engine.

It may be desirable to reduce fuel consumption in the engine. The reduction of the friction in moving devices in the engine, such as the consuming device, may reduce fuel consumption in the engine. A reduction in fuel consumption may also reduce pollutant emissions.

With respect to the reduction in friction power, a speedy warming of the engine oil and a rapid heating of the internal combustion engine, in particular after a cold start, may be desired. A rapid warming of the engine oil during the warm-up phase of the internal combustion engine may provide a correspondingly rapid fall in viscosity and thus a reduction in friction or friction power, in particular in the bearings supplied with oil.

In some examples, an internal combustion engine having at least one cylinder head, at least one cylinder block, connected to the at least one cylinder head and serving as an upper crankcase portion (e.g., upper crankcase half), for receiving a crankshaft in at least two bearings, and an oil circuit, comprising oil-carrying lines, for supplying the at least two bearings with oil, in which a pump for pumping the oil is connected by a supply line to an oil gallery, from which channels lead to the at least two bearings, may be provided.

A method for producing such an internal combustion engine is also described herein. The internal combustion engine described above may have reduced friction in the oil consuming components, thereby increasing the engine's fuel economy.

Further in some examples an engine may be provided with at least one cylinder head, at least one cylinder block, connected to the at least one cylinder head and may serve as an upper crankcase portion (e.g., upper crankcase half), for receiving a crankshaft in at least two bearings, and an oil circuit, comprising oil-carrying lines, for supplying the at least two bearings with oil, in which a pump for pumping the oil is connected by a supply line to an oil gallery, from which channels lead to the at least two bearings, where the inner wall of at least one oil-carrying line of the oil circuit is provided, at least in sections, with a thermal insulation.

The thermal insulation may be provided at least in sections in the oil-carrying lines, serves as a heat barrier, which decreases the heat transfer between the oil and the basic material of the block or head, for example aluminum or gray cast iron. Some of the mechanisms on which the heat transfer is based, namely heat conduction and convection, may be influenced by the introduction of a thermal insulation which has properties differing from the basic material, to be precise in the way in which less heat is extracted from the oil flowing through the oil-carrying lines (e.g., on the way to the consuming devices).

As a result, the oil-carrying lines, warm oil may be supplied more quickly to the consuming devices after a cold start. An oil of higher temperature, which has been warmed by a heating apparatus, may be pumped out of an insulating container or has been otherwise pre-warmed, for example in a heat exchanger, cools on the way to the consuming devices in the oil-carrying lines of the oil circuit less strongly due to the thermal insulation, so that warmer oil, or more quickly warmed oil, may be made available.

The warmer oil has a lower viscosity and leads to a reduction in the friction power of the consuming devices, in particular in the bearings. Consequently, as a result of the thermal insulation, the fuel consumption of the internal combustion engine is reduced, in particular after a cold start.

The internal combustion engine may include an oil pan which can be fitted onto the upper crankcase portion and serves as the lower crankcase portion and may collect the engine oil, and the pump delivers engine oil emanating from the oil pan via a supply line to the oil gallery.

According to this example, the crankcase is of two-part configuration, the upper crankcase portion being supplemented by an oil pan in which the recycled oil is collected. The oil pan can be equipped on the outer side with cooling ribs or stiffening ribs and may be made of sheet metal in a deep drawing process for example, whereas the upper crankcase portion may be a casting.

In the layout and design of the crankcase, it may be desirable to obtain a high stiffness in order to reduce vibrations and thereby positively influence noise development and noise emission.

Furthermore, the modularly constructed crankcase may be constructed in such a way that the working of the mounting and sealing surfaces, as well as the assembly, can be achieved in a simple manner to lower costs.

The internal combustion engine may include at least one cylinder head and/or the at least one cylinder block equipped with at least one integrated coolant jacket.

The heat which may be liberated in the combustion by the exothermic, chemical conversion of the fuel is dissipated partly via the walls delimiting the combustion chamber to the cylinder head and the cylinder block and partly via the exhaust gas flow to the adjoining component parts and the environment. In order to keep the thermal load within limits, a part of the heat flow led into the cylinder head or into the cylinder block may be dissipated by cooling.

Due to the substantially higher thermal capacity of fluids compared to air, substantially greater heat quantities can be dissipated with a fluid cooling system than with an air cooling system. The configuration of a fluid cooling system may include a head or block equipped with a coolant jacket, (i.e. the arrangement of the coolant channels leading the coolant through the head or block). The heat does not have to be conducted to the surface in order to be dissipated. The heat may be already delivered inside to the coolant (e.g., water mixed with additives). The coolant may be pumped by a pump disposed in the cooling circuit, so that it circulates in the coolant jacket. The heat delivered to the coolant is in this way led off from inside the head or block and extracted again from the coolant in a heat exchanger.

The oil-carrying lines may include thermal insulation. The thermal insulation may at least partly include a polymeric material (e.g., plastic) as the heat insulating material. The cylinder head and the cylinder block may be thermally and mechanically highly stressed component parts, so that, for the production, a high-strength material and/or a thermally resistant material may be used. By contrast, the surfaces which are subjected to oil, i.e. the inner walls of the oil-carrying lines, for the formation of a thermal insulation, may be provided with less strong materials, for example plastic, which is inexpensive and can be easily processed, in particular in solid and liquid form.

Plastic has a low heat transfer coefficient and possesses low conductivity and may be used for the formation of a heat barrier intended to make the heat transfer more difficult. For the same reasons, an internal combustion engine may be provided in which the thermal insulation at least partly includes ceramic as the heat-insulating material. Ceramic is a thermally particularly highly resistant material. However, ceramic may be brittle.

The inner wall of at least one oil-carrying line may be provided on the surface, at least in sections, with an oxide layer, which serves as the thermal insulation. In principle, for the surface treatment of the inner walls, chemical and physical processes can be used.

In this way, the inner wall of an oil-carrying line may be treated on the surface, for example by an anodic oxidization, so-called anodization. Anodic oxidation is an electrolytic process, in which an oxide layer is produced on the surface of the inner wall, which is distinguished by a substantially higher strength but also has properties for the formation of a heat barrier.

Another advantage of the surface treatment is that—for example, in anodization—the oxide layer grows from the surface into the material or metal, so that the geometric dimensions of the oil-carrying lines may remain unaltered, if desired. Thus, no design modifications may be made, if desired. As a result, such a configuration of the thermal insulation may be suitable for already designed internal combustion engines.

The internal combustion engine may also include a composite material at least jointly forming the thermal insulation. Composite materials offer the possibility of advantageously combining the properties of different materials and of thereby harnessing a combination of properties. One example of such a thermal insulation is a plastics cylindrical sleeve into which a stronger, for example meshed support structure is integrated or incorporated. In this way, use can also be made of heat-insulating materials which do not themselves exhibit sufficient strength (i.e. are not self-supporting) for example a rubber hose.

Additionally, the internal combustion engine may include shape memory material at least jointly forming the thermal insulation. Shape memory materials have the capability of changing their external form in dependence on the temperature, the magnetic field strength, the hydraulic pressure, to which they are exposed, or the like. Shape memory materials encompass all materials which have a shape memory, in particular the shape memory alloys such as NiTi (nitinol), Fe—Pt, Cu—Al—Ni, Fe—Pd, Fe—Ni, Cu—Zn—Al, CuAlMn, but also ceramics with shape memory, such as, for example, Ce-TZP ceramic.

If the transformation process is reversible, then the shape memory material may be constituted by a two-way shape memory material, otherwise by a one-way shape memory material. Within the description of a method, described in greater detail herein, it will become clear that in the present case, i.e. in the formation of a thermal insulation using a shape memory material, a one-way shape memory material may be adequate, since a one-off transformation process may be desired.

The internal combustion engine may also have an oil gallery including a thermal insulation, at least in sections. The oil gallery may be a main supply line to the bearings, which may have a larger diameter than the supply line, the inner walls of which substantially contribute to the formation of the heat transferring surface, and which has a high oil throughput and a high flow velocity, which is of importance with respect to heat transfer due to convection. For the above-stated reasons, a proportion of the heat is extracted from the oil in the oil gallery, i.e. as it flows through the oil gallery, so that the introduction of a thermal insulation into the oil gallery may make a detectable contribution to the reduction of the friction power.

For the formation of the so-called oil gallery, a main supply channel, which is oriented along the longitudinal axis of the crankshaft, may be provided. The main supply channel can be disposed above or below the crankshaft in the crankcase, or else at the same height, in particular can be integrated into the crankshaft.

In addition, embodiments of the internal combustion engine in which at least one channel leading from the oil gallery to the at least two bearings is provided, at least in sections, with a thermal insulation may also be provided, if desired.

In the case of internal combustion engines in which a heating apparatus for warming the oil is disposed in the oil circuit, examples where the inner walls of the oil-carrying lines between the heating apparatus and the at least two bearings are provided, at least in sections, with a thermal insulation may reduce friction within the engine. This example is founded on the intention that it is not desirable to re-cooled warmed oil on the way to the consuming devices, in particular the bearings, in the oil-carrying lines of the oil circuit due to the cold engine structure and the heat introduced into the oil by a heating apparatus is not desired to be lost again.

Further in some examples, the inner wall of at least one oil-carrying line integrated in the cylinder block and/or cylinder head is lined, at least in sections, with a thermal insulation. This example may be provided for designs in which a pre-existing line, namely a line incorporated into the cylinder block or head or an incorporated line portion, is provided with a thermal insulation, to be precise in the sense that the inner wall of this line or of this section is lined with the thermal insulation. The oil-carrying line or the oil-carrying line portion then includes the material of the block or head which forms the outer support structure, and, at least in sections, of the inner thermal insulation or the lining.

Further in some examples, at least one oil-carrying line is formed, in sections, fully from the thermal insulation. In contrast to the previously described example, the oil-carrying line—at least in sections—does not have an outer support structure formed from the basic material of the block or head, but rather the thermal insulation serves fully as a support structure.

One example of the internal combustion engine, in which the oil gallery is formed by the fact that a plastics pipe serving as the main supply channel is arranged in the cylinder block, for example is guided for mounting purposes through two bores sunk in the cylinder block, realizes both of the above-described examples. For the oil gallery as an oil-carrying line is constituted, in sections, by an oil-carrying line integrated in the cylinder block which is lined with a thermal insulation, namely in the region of the bores, and, in sections, by a line consisting fully of thermal insulation, namely at least in the section between the bores.

Further in some examples, a method may be provided for forming a cylinder block connectable to a cylinder head and serving as an upper crankcase portion is configured with at least two holders for the mounting of a crankshaft and with oil-carrying lines for supplying these at least two holders with oil, the oil-carrying lines comprising a supply line, which is connected to an oil gallery from which channels lead to at least two holders, and where the inner wall of at least one oil-carrying line is provided, at least in sections, with a thermal insulation.

That which has already been stated for the internal combustion engine applies also to the method. In some examples the method includes producing a cylinder block blank via a casting process, which blank is reworked to form the cylinder block. Further in some examples, the oil-carrying lines are at least partially jointly formed within the production of the cylinder block blank by a casting process.

In principle, the oil-carrying lines, within the casting process, can be fully or partially jointly formed, or first incorporated into the ready-case cylinder block blank. A reworking of the oil-carrying lines is possible, for example the drilling of the oil gallery for the formation of an exactly cylindrical supply channel which may become desired for fitting accuracy, if, for example, a plastics sleeve is intended to be introduced into the oil gallery for the formation of the thermal insulation.

For the above-stated reasons, variants of the method in which for the formation of the thermal insulation, a prefabricated sleeve is introduced into at least one oil-carrying line may be used. The openings to the channels leading from the oil gallery to channels carrying the bearings can be made prior to or after the fitting into the sleeve. Further in some variants the sleeve may have an anti-twist protection with which a predefined position of the sleeve in the oil gallery is ensured.

The two following method variants may be used for oil-carrying lines which have substantially no exact geometric form, i.e. are of non-uniform configuration, i.e., in particular, are non-cylindrical, and therefore do not entail the requirements to form a fit with a prefabricated thermal insulation, for example a sleeve. Such oil-carrying lines can be, for example, lines which are formed in a casting process and which are not reworked or are only roughly reworked. Further in some variants, the inner wall of at least one oil-carrying line, for the formation of a thermal insulation, is subjected, at least in sections, to a surface treatment. In this example, the inner wall of an oil-carrying line may be treated on the surface in order to form the thermal insulation, without additional material, if desired. Thus the inner wall can be subjected, for example, to a surface treatment for the formation of an oxide layer serving as the thermal insulation. Other variants include a hose produced from a shape memory material is introduced into at least one oil-carrying line, the shape memory being activated to form the thermal insulation. The activation of the shape memory can be realized, for example, by heat or pneumatic or hydraulic pressure. For example, an elastic hose produced from a shape memory material can be introduced, for example drawn into the oil gallery, which elastic hose, upon activation, assumes a sleeve-shaped, rigid form and lines the inner wall of the oil gallery with a thermal insulation. For this, no reversible, but merely a one-off transformation process may be wanted, so that a so-called one-way shape memory also meets desired specifications.

FIG. 1 shows a cross-sectional view of an example internal combustion engine 50. The engine 50 includes a holder 2 for the mounting of a crankshaft 52 in the cylinder block 1. The engine also includes a cylinder head 54 is coupled to the cylinder block 1. The cylinder block 1 and the cylinder head 54 form at least one combustion chamber 56. A piston mechanically coupled to the crankshaft may be positioned within the combustion chamber 56.

An oil pan 58 is coupled to the cylinder block 1. The oil pan 58 may include a lower crankcase portion 60. Likewise, the cylinder block 1 may include an upper crankcase portion 62.

While only a single combustion chamber 56 and holder 2 (e.g., bearing cap) are shown, it will be appreciated that the engine 50 may include two or more combustion chambers and holders (e.g., bearing caps) and supply lines. The supply lines are described in greater detail herein.

The upper crankcase portion 62 (e.g., upper crankcase half) is configured to mount the crankshaft 52 at the holder 2, of which one is represented in FIG. 1. As an intermediate element between the holder 2 and crankshaft, a bearing shell 3 is provided. The holder 2 may be a bearing cap.

The bearing shell 3 is included in a bearing 64 (e.g., slide bearing). The bearing 64 is at least partially enclosed within the holder 2. The bearing 64 is configured to support and enable rotation of a crankshaft 52. It will be appreciated that in some examples, the engine 50 may include two or more bearings and corresponding holders.

The engine 50 includes a lubrication system 70. The lubrication system 70 may include the oil pan 58. As previously discussed, the oil pan 58 may be configured to store and/or receive oil from lubrication components such as the bearing 64. The lubrication system 70 may be referred to as an oil circuit. The lubrication system 70 may further include a plurality of oil-carrying lines 4 configured to supply oil to the holder 2. The oil-carrying lines include an oil gallery 5 (e.g., main oil gallery), from which a supply line 6 leads to the holder 2. The supply line 6 includes an inlet 80 opening into the oil gallery 5 and an outlet 82 opening into the bearing cap 2. Thus, the inlet 80 receives oil from the oil gallery 5 and the outlet 82 flows oil to the bearing 64. It will be appreciated that a second supply line similar to the first supply line may branch off of the oil gallery 5 and supply oil to a second bearing supporting the crankshaft 52.

It will be appreciated that the oil-carrying lines 4 also include the supply line 6. The oil gallery 5 may lead along the longitudinal axis of the crankshaft through the cylinder block 1 and may run above the bearings 64, so that the oil can be fed into a region of low pressure into the holder 2, in some examples. However, other oil gallery configurations have been contemplated. The lubrication system further includes a pump 72 having a pick-up tube 74 position in the oil pan 58. The pump 72 is configured to receive oil from the oil pan and flow oil to downstream components. An oil-carrying line depicted via arrow 76 is connected to the pump 72 and the oil gallery 5. In this way, oil may flow from pump to the oil gallery via an oil-carrying line.

The lubrication system 70 may also include a heating apparatus 75, in some examples. The heating apparatus 75 may be configured to heat the oil flowing through oil-carrying line 76.

The inner walls 38 of the oil-carrying lines 4 are provided with a thermal insulation 7. Specifically, in the example shown in FIG. 1 thermal insulation 7 is included in both the oil gallery 5 as well as the supply line 6. However, it will be appreciated that only one of the oil gallery 5 and supply line 6 may include thermal insulation. The oil-carrying line 76 may also be provided with thermal insulation. Additionally, the thermal insulation 7 is depicted extending down the length of the supply line 6 and extending 360° around the inner wall 38 of the supply line. However, in other examples the thermal insulation 7 may only extend down a portion of the supply line 6 and may extend less than 360° around the inner wall of the supply line. Further the thermal insulation in the oil gallery 5 is shown extending 360° around the inner wall 38. However, in other examples, the thermal insulation 7 may extend less than 360° around the inner wall 38 of the oil gallery 5. Furthermore, the thermal insulation in the oil gallery 5 may extend down the entire length of the oil gallery or may only extend down a portion of the length of the oil gallery.

Further in some examples, the inner wall of the oil gallery 5 may include a different type of thermal insulation than the inner wall of the supply line 6 and/or the thermal insulation in the oil-carrying line 76. However in other examples, the inner walls of the oil gallery 5, the supply line 6, and/or oil-carrying line 76 may include a similar (e.g., equivalent) type of thermal insulation. The thermal insulation may include an oxide layer. Further in some examples, the thermal insulation includes at least one of a polymeric material and a composite material. Still further in some examples, the thermal insulation may include shape memory material. The type of thermal insulation used in the engine may be selected based on desired insulation characteristics.

Figure 2:
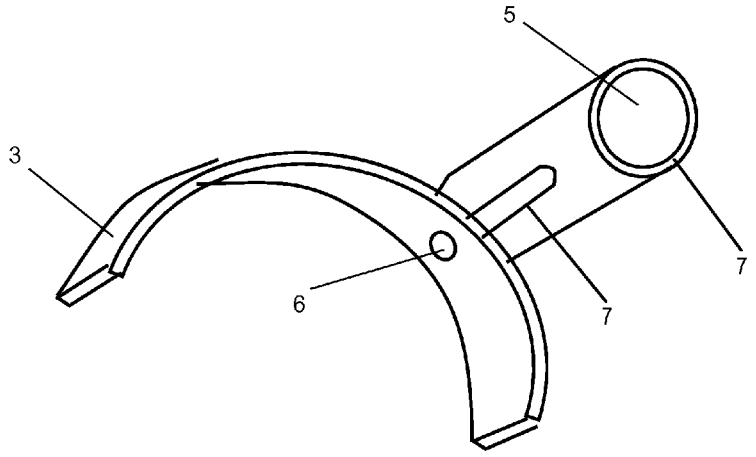
FIG. 2 shows in a perspective representation the thermal insulation of the oil-carrying lines shown in FIG. 1.

FIG. 2 shows in a perspective representation the thermal insulation 7 of the oil-carrying lines 4 shown in FIG. 1, together with bearing shell 3. Comments shall now be made in supplement to FIG. 1, so that, for the rest, reference is made to FIG. 1. For the same component parts, the same reference symbols have been used.

As previously discussed the thermal insulation 7 may be a heat insulating material, such as a polymeric material (e.g., plastic). In one example, for the formation of the thermal insulation 7, prefabricated sleeves may be introduced into the oil-carrying lines 4, namely the oil gallery 5 and the supply line 6. The sleeve introduced into the supply line 6 may be clamped, and thus fixed, between the bearing shell 3 and the inner wall of the oil gallery 5.

FIGS. 1-2 provide for a lubrication system in an internal combustion engine comprising a crankshaft bearing supporting a crankshaft, a supply line including an outlet flowing oil to the bearing and an inlet receiving oil from an oil gallery, and thermal insulation at least partially surrounding at least a portion of an inner wall of the supply line and/or the oil gallery.

FIGS. 1-2 further provide for a lubrication system where the thermal insulation includes an oxide layer. FIGS. 1-2 further provide for a lubrication system where the thermal insulation includes at least one of a polymeric material and a composite material. FIGS. 1-2 further provide for a lubrication system where the supply line and the oil gallery are integrated into the cylinder block. FIGS. 1-2 further provide for a lubrication system where the thermal insulation includes shape memory material.

Figure 3:
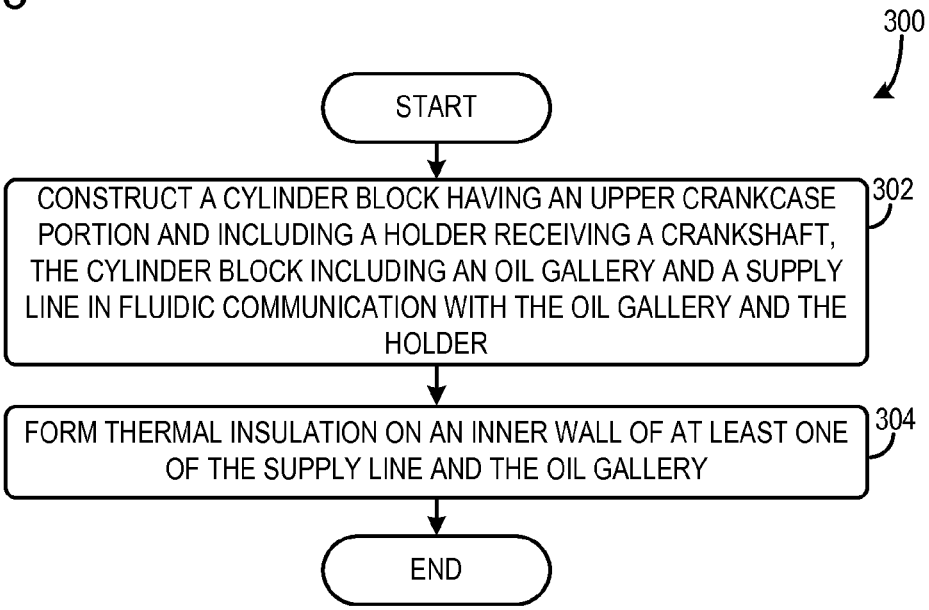
FIG. 3 shows a method for producing an internal combustion engine.

FIG. 3 shows a method 300 for producing an internal combustion engine. Method 300 may be used to produce the internal combustion engine described above with regard to FIGS. 1 and 2 or may be used to construct another suitable internal combustion engine.

At 302 the method includes constructing a cylinder block having an upper crankcase portion and including a holder receiving a crankshaft, the cylinder head including an oil gallery and a supply line in fluidic communication with the oil gallery and the holder. Constructing the cylinder block may includes casting a cylinder block blank, the blank being reworked to form the cylinder block, in some examples. Further in some examples, at least one of the oil gallery and the supply line may be jointly formed with the cylinder block via the casting of the cylinder block blank.

Next at 304 the method includes forming thermal insulation on an inner wall of at least one of the supply line and the oil gallery. Forming thermal insulation may include introducing a prefabricated sleeve into at least one of the oil gallery and the supply line, in some examples. Forming the thermal insulation may include subjecting the inner wall to a surface treatment, in some examples. Further in some examples, forming thermal insulation may include producing a hose from a shape memory material, introducing the hose into at least one of the oil gallery and the supply line, and activating the shape memory material to form the thermal insulation.

Note that the example control and estimation routines included herein can be used with various engine and/or vehicle system configurations. The specific routines described herein may represent one or more of any number of processing strategies such as event-driven, interrupt-driven, multi-tasking, multi-threading, and the like. As such, various acts, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated acts or functions may be repeatedly performed depending on the particular strategy being used.

It will be appreciated that the configurations and methods disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An internal combustion engine comprising:

a cylinder head;

a cylinder block connected to the cylinder head, the cylinder block including an upper crankcase portion receiving a crankshaft and a bearing; and an oil circuit including oil-carrying lines supplying the bearing with oil, the oil-carrying lines including an oil gallery connected to a supply line and a pump, the supply line flowing oil to the bearing, at least a portion of an inner wall of the supply line including thermal insulation having shape memory material activated to form a shape lining the inner wall.

2. The internal combustion engine of claim 1, where the thermal insulation includes a polymeric material.

3. The internal combustion engine of claim 1, where the thermal insulation includes an oxide layer.

4. The internal combustion engine of claim 1, where the thermal insulation includes a composite material.

5. The internal combustion engine of claim 1, where the oil gallery includes at least a portion having thermal insulation.

6. The internal combustion engine of claim 1, further comprising a second bearing and a second supply line flowing oil to the second bearing coupled to the oil gallery.

7. The internal combustion engine of claim 1, further comprising a heating apparatus included in the oil circuit, where inner walls of oil-carrying lines extending from the heating apparatus to the bearing include thermal insulation, at least in sections.

8. The internal combustion engine of claim 1, where at least a portion of an inner wall of at least one of the oil-carrying lines is integrated in the cylinder block and is lined, at least in sections, with a thermal insulation.

9. The internal combustion engine of claim 1, where at least one of the oil-carrying lines is formed, at least in sections, fully from the thermal insulation external to the cylinder head and cylinder block.

10. A method for producing an internal combustion engine comprising:

constructing a cylinder block having an upper crankcase portion and including a holder receiving a crankshaft, the cylinder block including an oil gallery and a supply line in fluidic communication with the oil gallery and the holder; and forming thermal insulation on an inner wall of at least one of the supply line and the oil gallery;

where forming thermal insulation includes producing a hose from a shape memory material, introducing the hose into at least one of the oil gallery and the supply line, and activating the shape memory material to form the thermal insulation.

11. The method of claim 10, where constructing the cylinder block includes casting a cylinder block blank, the cylinder block blank being reworked to form the cylinder block.

12. The method of claim 11, where at least one of the oil gallery and the supply line are jointly formed with the cylinder block via casting of the cylinder block blank.

13. The method of claim 10, wherein forming the thermal insulation includes introducing a prefabricated sleeve into at least one of the oil gallery and the supply line.

14. The method of claim 10, where forming thermal insulation includes subjecting the inner wall to a surface treatment.

15. A lubrication system in an engine comprising:

a crankshaft bearing supporting a crankshaft;

a supply line including an outlet flowing oil to the crankshaft bearing and an inlet receiving oil from an oil gallery; and thermal insulation at least partially surrounding an inner wall of the supply line and the oil gallery, the thermal insulation having a temperature-activated shape memory material to form a shape lining the inner wall.

16. The lubrication system of claim 15, where the thermal insulation includes an oxide layer.

17. The lubrication system of claim 15, where the thermal insulation includes at least one of a polymeric material and a composite material.

18. The lubrication system of claim 15, where the supply line and the oil gallery are integrated into a cylinder block having a bearing cap receiving the crankshaft bearing.

19. The lubrication system of claim 15, wherein the shape memory material includes at least one of NiTi (nitinol), Fe—Pt, Cu—Al—Ni, Fe—Pd, Fe—Ni, Cu—Zn—Al, CuAlMn, and Ce-TZP.

* * * * *